US012623875B2

(12) United States Patent
Takezawa

(10) Patent No.: US 12,623,875 B2
(45) Date of Patent: May 12, 2026

(54) WEB CONVEYING DEVICE, IMAGE FORMING APPARATUS, AND CONVEYING ROLLER CAPABLE OF EFFICIENTLY SUCKING AIR THAT ENTERS BETWEEN WEB AND CONVEYING ROLLER

(71) Applicant: KYOCERA Document Solutions Inc., Osaka (JP)

(72) Inventor: Mashio Takezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 168 days.

(21) Appl. No.: 18/543,608

(22) Filed: Dec. 18, 2023

(65) Prior Publication Data

US 2024/0208754 A1 Jun. 27, 2024

(30) Foreign Application Priority Data

Dec. 21, 2022 (JP) ..... 2022-203943

(51) Int. Cl.
*B65H 20/12* (2006.01)
*B65H 18/14* (2006.01)
(Continued)

(52) U.S. Cl.
CPC ..... *B65H 20/12* (2013.01); *B65H 20/14* (2013.01); *B65H 27/00* (2013.01); *B65H 18/145* (2013.01);
(Continued)

(58) Field of Classification Search
CPC ..... B65H 20/00; B65H 20/10; B65H 20/12; B65H 20/14; B65H 20/26; B65H 27/00;
(Continued)

(56) References Cited

U.S. PATENT DOCUMENTS 4,207,998 A * 6/1980 Schmid ..... B65H 20/12 226/193
4,466,605 A * 8/1984 Leuthold ..... B65H 29/243 271/195
(Continued)

FOREIGN PATENT DOCUMENTS

CN 114380111 A * 4/2022 ..... B65H 20/12
EP 4276931 A1 * 11/2023 ..... H01M 4/0471
(Continued)

*Primary Examiner* — Victoria P Augustine
*Assistant Examiner* — Raveen J Dias
(74) *Attorney, Agent, or Firm* — Alleman Hall LLP

(57) ABSTRACT

A web conveying device includes a roller portion, a first air passage, a second air passage, and an air current generation portion. The roller portion rotates in contact with a web. The first air passage extends in an axial direction of a rotation shaft of the roller portion inside an outer peripheral portion of the roller portion and communicates with an outside at an end on a side of a first direction parallel to the axial direction. The second air passage extends from the first air passage in a direction that forms an obtuse angle with respect to the first direction and communicates with the outside of the outer peripheral portion. The air current generation portion generates an air current that flows in the first air passage in the first direction.

12 Claims, 11 Drawing Sheets

(51) Int. Cl.
*B65H 20/14* (2006.01)
*B65H 23/24* (2006.01)
*B65H 27/00* (2006.01)

(52) U.S. Cl.
CPC .... *B65H 23/245* (2013.01); *B65H 2404/1362* (2013.01); *B65H 2404/1363* (2013.01); *B65H 2406/12* (2013.01); *B65H 2406/121* (2013.01); *B65H 2406/1211* (2013.01); *B65H 2406/312* (2013.01); *B65H 2406/3122* (2013.01); *B65H 2406/33* (2013.01); *B65H 2406/331* (2013.01); *B65H 2406/332* (2013.01); *B65H 2406/36* (2013.01); *B65H 2406/366* (2013.01); *B65H 2406/3662* (2013.01); *B65H 2406/3663* (2013.01); *B65H 2408/215* (2013.01); *B65H 2801/03* (2013.01); *B65H 2801/15* (2013.01)

(58) Field of Classification Search
CPC ..... B65H 18/10; B65H 18/103; B65H 18/14; B65H 18/145; B65H 18/16; B65H 23/025; B65H 23/0251; B65H 23/038; B65H 23/24; B65H 23/243; B65H 29/245; B65H 2406/12; B65H 2406/121; B65H 2406/122; B65H 2406/13; B65H 2406/131; B65H 2406/15; B65H 2406/312; B65H 2406/3122; B65H 2406/33; B65H 2406/331; B65H 2301/4461; B65H 2404/1362; B65H 2404/1363; B65H 2408/215; B65H 2801/03; B65H 2801/06; B65H 2801/12; B65H 2801/15; B65H 2801/18; B65H 2801/21; B65H 51/16; B65H 23/245; B65H 2406/30; B65H 2406/332; B65H 2406/36; B65H 2406/361; B65H 2406/362; B65H 2406/3622; B65H 2406/363; B65H 2406/3632; B65H 2406/366; B65H 2406/3662; B65H 2406/36625; B65H 2406/3663; B41J 13/00; B41J 13/02; B41J 13/03; B41J 13/042; B41J 13/048; B41J 13/076; B41J 13/226; B41J 11/00; B41J 11/02; B41J 11/04; B41J 11/0045; B41J 11/005; B41J 11/0085; B41J 15/00; B41J 15/04; B41J 15/046; B41J 15/048; F16C 13/00; F16C 13/006

See application file for complete search history.

(56) References Cited

U.S. PATENT DOCUMENTS 4,552,069 A * 11/1985 Jahn ..... B41F 22/00 29/445
4,660,825 A * 4/1987 Umezawa ..... B41L 29/14 271/276
4,882,854 A * 11/1989 Wedel ..... D21F 5/042 34/115
4,949,475 A * 8/1990 Roerig ..... F26B 13/16 34/115
4,998,658 A * 3/1991 Distefano ..... B65H 27/00 226/95
5,084,985 A * 2/1992 Ventola ..... B65H 20/12 34/115
5,358,163 A * 10/1994 Naka ..... B65H 20/12 226/95
5,371,954 A * 12/1994 Pinter ..... F26B 13/16 34/115
5,423,468 A * 6/1995 Liedtke ..... B65H 23/24 242/615.12
5,465,502 A * 11/1995 Holik ..... D21F 3/10 34/115
5,520,317 A * 5/1996 Eckert ..... B65H 23/32 242/615.12
5,913,268 A * 6/1999 Jackson ..... B65H 15/004 101/232
5,915,648 A * 6/1999 Madrzak ..... D21F 1/36 162/368
6,048,120 A * 4/2000 Kerr ..... B41J 13/226 400/662
6,328,245 B1 * 12/2001 Kastfelt ..... B65H 16/08 242/563.2
6,427,941 B1 * 8/2002 Hikita ..... F26B 13/16 226/185
6,488,194 B1 * 12/2002 Couturier ..... B65H 20/12 271/276
6,524,173 B1 * 2/2003 Nelson ..... A47L 11/4075 451/178
6,533,217 B2 * 3/2003 Lind ..... D21F 1/40 226/97.1
9,902,564 B1 * 2/2018 Huang ..... B65H 20/12
11,046,055 B1 * 6/2021 Yang ..... F16C 13/006
2004/0121673 A1 * 6/2004 Geus ..... D01D 5/0985 442/50
2004/0159999 A1 * 8/2004 Dematteis ..... B65H 45/24 271/264
2006/0278360 A1 * 12/2006 Solberg ..... B65H 23/24 162/272
2007/0012205 A1 * 1/2007 Chevalier ..... B41F 35/007 101/226
2007/0228607 A1 * 10/2007 Narukawa ..... B29D 7/01 264/316
2008/0218905 A1 * 9/2008 Biskeborn ..... G11B 15/43
2009/0044712 A1 * 2/2009 Milliken ..... B65H 23/038 101/228
2010/0064917 A1 * 3/2010 Blanchard ..... B41F 22/00 101/483
2011/0135405 A1 * 6/2011 Miyaji ..... H10K 71/00 406/70
2012/0097784 A1 * 4/2012 Liao ..... B65H 20/12 242/538
2013/0108790 A1 * 5/2013 Dehn ..... B41J 11/04 427/256
2013/0119182 A1 * 5/2013 Higeta ..... B65H 18/145 242/538.1
2017/0050816 A1 * 2/2017 Michler ..... B65H 20/12
2017/0259466 A1 * 9/2017 Domeniconi ..... D21F 3/10
2021/0189551 A1 * 6/2021 Sun ..... D06B 23/028
2021/0230742 A1 * 7/2021 Okami ..... C23C 14/205
2022/0314624 A1 * 10/2022 Ueda ..... B41J 11/0085
2023/0234797 A1 * 7/2023 Chokyu ..... B65H 23/32
2024/0092598 A1 * 3/2024 Matsuya ..... B65H 27/00
2024/0174473 A1 * 5/2024 Maida ..... B41J 2/01
2024/0208756 A1 * 6/2024 Takezawa ..... B65H 27/00

FOREIGN PATENT DOCUMENTS

JP 2021021552 A 2/2021
WO WO-2018198633 A1 * 11/2018 ..... G03G 15/20
WO WO-2024121940 A1 * 6/2024 ..... B65H 27/00

* cited by examiner

WEB CONVEYING DEVICE, IMAGE FORMING APPARATUS, AND CONVEYING ROLLER CAPABLE OF EFFICIENTLY SUCKING AIR THAT ENTERS BETWEEN WEB AND CONVEYING ROLLER

INCORPORATION BY REFERENCE

This application is based upon and claims the benefit of priority from the corresponding Japanese Patent Application No. 2022-203943 filed on Dec. 21, 2022, the entire contents of which are incorporated herein by reference.

BACKGROUND

The present disclosure relates to a web conveying device, an image forming apparatus, and a conveying roller.

There is known a web conveying device including a conveying roller that conveys a web. In this type of web conveying device, air may enter between the web and the conveying roller, and this air may cause the conveying roller to slip against the web. On the other hand, a web conveying device capable of sucking air that enters between the web and the conveying roller from a suction hole formed in an outer peripheral portion of the conveying roller is known as a related art.

Specifically, the web conveying device according to the related art includes a first air passage, a second air passage, and a suction mechanism. The first air passage extends in the axial direction of a rotation shaft of the conveying roller inside the conveying roller, and one end in the extending direction is connected to the suction mechanism. The second air passage extends from the first air passage along the radial direction of the conveying roller and communicates with the suction hole. The suction mechanism sucks air in the first air passage.

SUMMARY

A web conveying device according to one aspect of the present disclosure includes a roller portion, a first air passage, a second air passage, and an air current generation portion. The roller portion rotates in contact with a web. The first air passage extends in an axial direction of a rotation shaft of the roller portion inside an outer peripheral portion of the roller portion and communicates with an outside at an end on a side of a first direction parallel to the axial direction. The second air passage extends from the first air passage in a direction that forms an obtuse angle with respect to the first direction and communicates with the outside of the outer peripheral portion. The air current generation portion generates an air current that flows in the first air passage in the first direction.

An image forming apparatus according to another aspect of the present disclosure includes the web conveying device and an image forming portion. The image forming portion forms an image on the web conveyed by the web conveying device.

A conveying roller according to another aspect of the present disclosure includes a roller portion, a first air passage, and a second air passage. The roller portion rotates in contact with a web. The first air passage extends in an axial direction of a rotation shaft of the roller portion inside an outer peripheral portion of the roller portion and communicates with an outside at an end on a side of a first direction parallel to the axial direction. The second air passage extends from the first air passage in a direction that forms an obtuse angle with respect to the first direction and communicates with the outside of the outer peripheral portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments of the present disclosure will be described below with reference to the drawings. It is noted that the following embodiments are examples of embodying the present disclosure and do not limit the technical scope of the present disclosure.

First Embodiment

Figure 1:
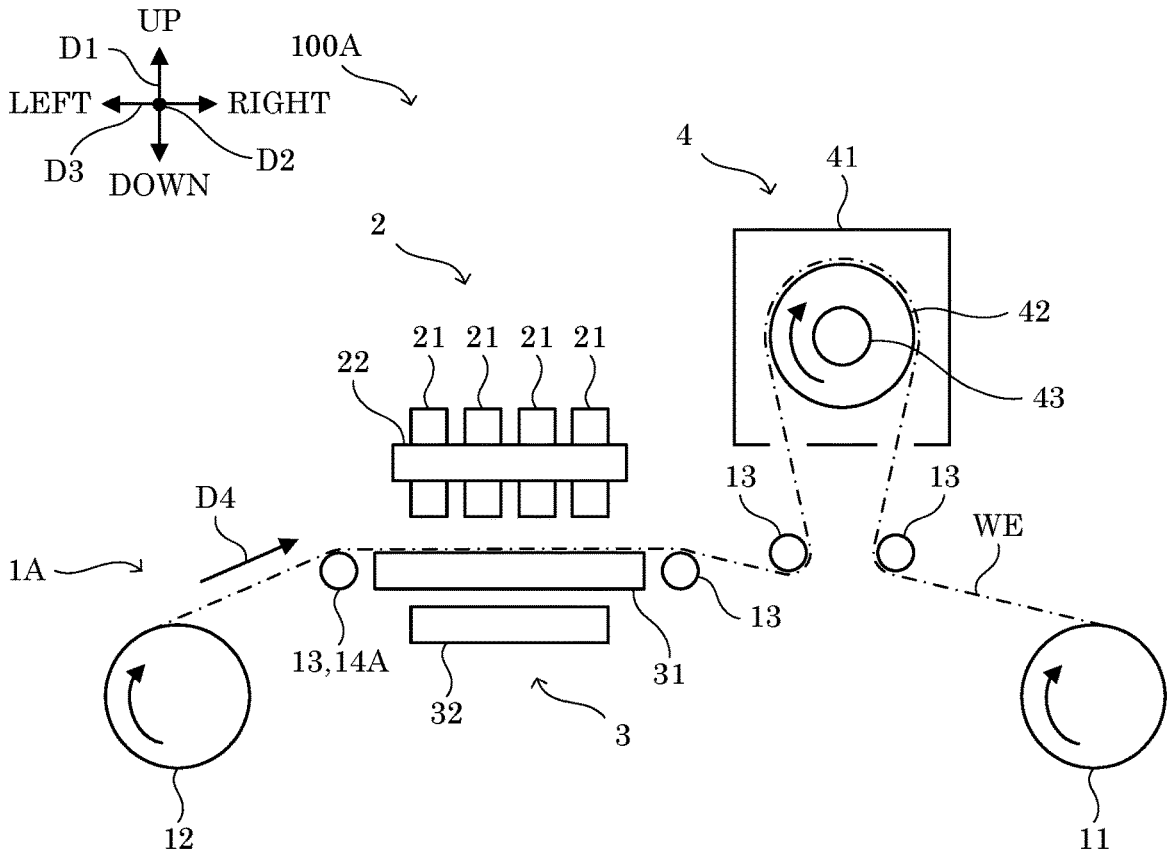
FIG. 1 is a diagram showing a configuration of an image forming apparatus according to a first embodiment of the present disclosure.
Figure 2:
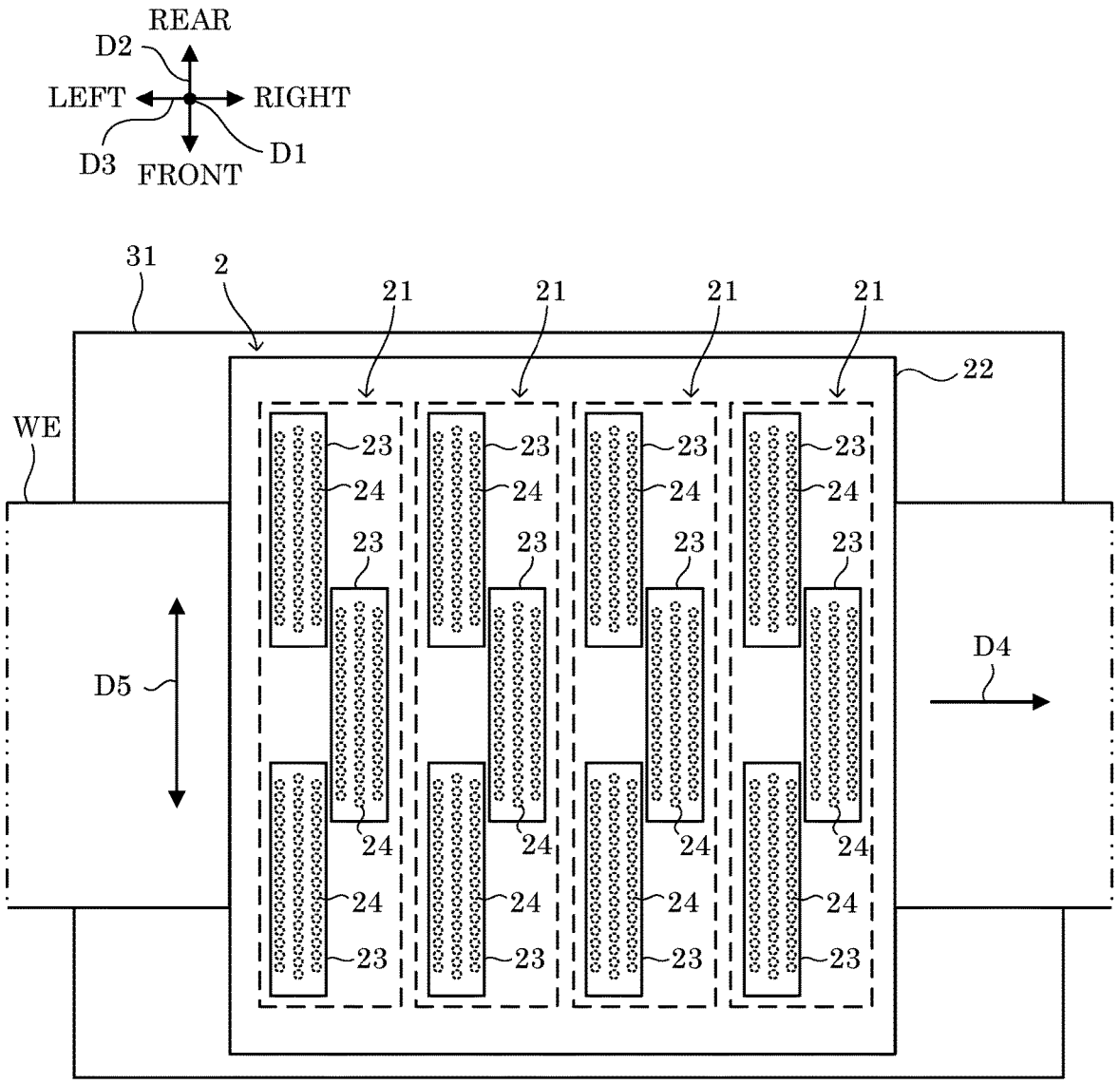
FIG. 2 is a diagram showing a configuration of an image forming portion of the image forming apparatus according to the first embodiment of the present disclosure.

First, a configuration of an image forming apparatus 100A according to a first embodiment of the present disclosure will be described with reference to FIG. 1 and FIG. 2. Here, FIG. 1 is a cross-sectional view showing a configuration of the image forming apparatus 100A. In addition, FIG. 2 is a top view of an image forming portion 2. It is noted that a web WE is indicated by a dash-dot-dash line in FIG. 1.

It is noted that, for convenience of description, the vertical direction in an installed state (the state shown in FIG. 1) in which the image forming apparatus 100A can be used is defined as an up-down direction D1. In addition, a front-rear direction D2 is defined assuming that the surface of the image forming apparatus 100A shown in FIG. 1 on the near side on the figure is the front side (front surface). In addition, a left-right direction D3 is defined with reference to the front side of the image forming apparatus 100A in the installed state.

The image forming apparatus 100A is an inkjet printer that can form an image based on image data on a web WE (see FIG. 1) by an inkjet method. For example, in the image forming apparatus 100A, an image is formed using a water-based pigment ink containing pigments and water.

The web WE is a thin and soft strip-shaped printing medium. For example, the web WE is a plastic film. It is noted that the web WE may be paper, cloth, or the like.

As shown in FIG. 1, the image forming apparatus 100A includes a web conveying portion 1A, an image forming portion 2, a first drying portion 3, and a second drying portion 4.

The web conveying portion 1A conveys the web WE (see FIG. 1). The web conveying portion 1A is an example of the web conveying device of the present invention.

As shown in FIG. 1, the web conveying portion 1A includes a take-up roller 11, a feeding roller 12, and a plurality of conveying rollers 13.

A web WE in the form of a roll is attached to the feeding roller 12 so as to be pulled out. The take-up roller 11 pulls out the web WE from the feeding roller 12 and takes up the pulled-out web WE. The feeding roller 12 feeds the web WE along a conveying direction D4 (see FIG. 1) which is the direction in which the web WE is taken up by the take-up roller 11. The plurality of conveying rollers 13 are provided along a predetermined conveying path of the web WE from the feeding roller 12 to the take-up roller 11. Each of the conveying rollers 13 is used to convey the web WE. The web conveying portion 1A conveys the web WE along the conveying direction D4 using the plurality of conveying rollers 13.

The image forming portion 2 forms an ink image on a first surface of the web WE conveyed by the web conveying portion 1A.

As shown in FIG. 1 and FIG. 2, the image forming portion 2 includes four line heads 21 and a head frame 22.

As shown in FIG. 1, the four line heads 21 are provided along the conveying path of the web WE. For example, the web WE is guided along the horizontal plane by a guide plate 31 (see FIG. 1) of the first drying portion 3 provided on the conveying path of the web WE. The four line heads 21 are provided to face the web WE on the upper side of the web WE guided along the horizontal plane. The first surface of the web WE is a surface of the web WE that faces the line heads 21. The head frame 22 holds the four line heads 21.

Each of the line heads 21 ejects ink droplets toward the first surface of the web WE pulled out from the feeding roller 12 by the take-up roller 11 to form an ink image on the first surface. The four line heads 21 eject ink droplets of different colors. Specifically, each of the line heads 21 ejects ink droplets of any one color of cyan, magenta, yellow, and black.

As shown in FIG. 2, each of the line heads 21 includes three print heads 23. In each of the line heads 21, the three print heads 23 are arranged in a staggered manner along a width direction D5 (see FIG. 2) that is orthogonal to the conveying direction D4. It is noted that each of the line heads 21 may include four or more print heads 23.

Each of the print heads 23 has an ink ejection surface that faces the first surface of the web WE. A plurality of nozzles 24 (see FIG. 2) are formed on the ink ejection surface. The nozzles 24 are formed in a plurality of rows along the conveying direction D4. Each of the nozzles 24 has an ink ejection port for ejecting ink droplets onto the first surface of the web WE.

Each of the line heads 21 controls whether and when ink is ejected by each of the nozzles 24 in accordance with a control signal input from a control portion (not shown). Thus, a color image is formed on the first surface of the web WE with four color inks of cyan, magenta, yellow, and black.

The first drying portion 3 heats the web WE at a position facing the four line heads 21 with the web WE interposed therebetween to dry the ink ejected onto the first surface of the web WE (see FIG. 1).

As shown in FIG. 1, the first drying portion 3 includes the guide plate 31 and a first heater 32.

The guide plate 31 comes into contact with the second surface of the web WE pulled out from the feeding roller 12 by the take-up roller 11, and guides the web WE along the conveying path of the web WE. In addition, the guide plate 31 comes into contact with the second surface of the web WE and transfers thermal energy supplied from the first heater 32 to the web WE. The second surface of the web WE is a surface on the back side of the first surface of the web WE. For example, the guide plate 31 is a flat plate-shaped member that comes into contact with the second surface of the web WE and guides the web WE conveyed by the web conveying portion 1A along the horizontal plane.

The first heater 32 supplies thermal energy to the guide plate 31. Specifically, as shown in FIG. 1, the first heater 32 is provided at a position where the guide plate 31 is interposed between the first heater 32 and the four line heads 21. For example, the first heater 32 emits infrared rays toward the guide plate 31. For example, the first heater 32 is a halogen heater. It is noted that the first heater 32 may be a ceramic heater, an IH heater, or a hot water heater.

For example, in the image forming apparatus 100A, a first temperature sensor (not shown) capable of detecting the surface temperature of the guide plate 31 is used to control the driving of the first heater 32. For example, in the image forming apparatus 100A, a control portion (not shown) controls the driving of the first heater 32 so that the temperature detected by the first temperature sensor does not exceed a predetermined first temperature. For example, the first temperature is 60 degrees.

In the first drying portion 3, the thermal energy generated by the first heater 32 is transmitted to the web WE via the guide plate 31. The web WE is thereby heated.

The second drying portion 4 heats the web WE downstream of the four line heads 21 in the conveying direction D4 to dry the ink ejected onto the first surface of the web WE (see FIG. 1).

As shown in FIG. 1, the second drying portion 4 includes a housing 41, a heat transfer drum 42, and a second heater 43.

The housing 41 houses the heat transfer drum 42. For example, as shown in FIG. 1, the housing 41 is formed in a box shape having an entrance port and an exit port for the web WE on the bottom surface.

The heat transfer drum 42 comes into contact with the second surface of the web WE pulled out from the feeding roller 12 by the take-up roller 11, and guides the web WE along the conveying path of the web WE. In addition, the heat transfer drum 42 comes into contact with the second surface of the web WE and transfers thermal energy supplied from the second heater 43 to the web WE. The heat transfer drum 42 is a hollow drum-shaped member having a rotation shaft along the width direction D5. The heat transfer drum 42 is rotatably supported by the housing 41.

The second heater 43 supplies thermal energy to the heat transfer drum 42. Specifically, as shown in FIG. 1, the second heater 43 is provided inside the heat transfer drum 42. For example, the second heater 43 emits infrared rays toward the heat transfer drum 42. For example, the second heater 43 is a halogen heater. It is noted that the second heater 43 may be a ceramic heater, an IH heater, or a hot water heater.

For example, in the image forming apparatus 100A, a second temperature sensor (not shown) capable of detecting the surface temperature of the heat transfer drum 42 is used to control the driving of the second heater 43. For example, in the image forming apparatus 100A, a control portion (not shown) controls the driving of the second heater 43 so that the temperature detected by the second temperature sensor does not exceed a predetermined second temperature higher than the first temperature. For example, the second temperature is 130 degrees.

In the second drying portion 4, the thermal energy generated by the second heater 43 is transmitted to the web WE via the heat transfer drum 42. The web WE is thereby heated. It is noted that the inside of the housing 41 is ventilated by an air blowing fan (not shown). This suppresses the filling of water vapor generated by drying of ink.

By the way, in the web conveying portion 1A, air may enter between the web WE and the conveying roller 13, and this air may cause the conveying roller 13 to slip against the web WE. On the other hand, a web conveying device capable of sucking air that enters between the web WE and the conveying roller 13 from a suction hole formed in an outer peripheral portion of the conveying roller 13 is known as a related art.

Specifically, the web conveying device according to the related art includes a first air passage, a second air passage, and a suction mechanism. The first air passage extends in the axial direction of the rotation shaft of the conveying roller 13 inside the conveying roller 13, and one end in the extending direction is connected to the suction mechanism. The second air passage extends from the first air passage along the radial direction of the conveying roller 13 and communicates with the suction hole. The suction mechanism sucks air in the first air passage.

However, in the web conveying device according to the related art described above, the second air passage extends from the first air passage in a direction orthogonal to the flow direction of the air current in the first air passage, resulting in greater ventilation resistance at the connection portion between the second air passage and the first air passage. Therefore, the air that enters between the web WE and the conveying roller 13 cannot be sucked efficiently.

In contrast, the image forming apparatus 100A according to the first embodiment of the present disclosure can efficiently suck air that enters between the web WE and the conveying roller 13, as will be described below.

[Configuration of Web Conveying Portion 1A]

Figure 3:
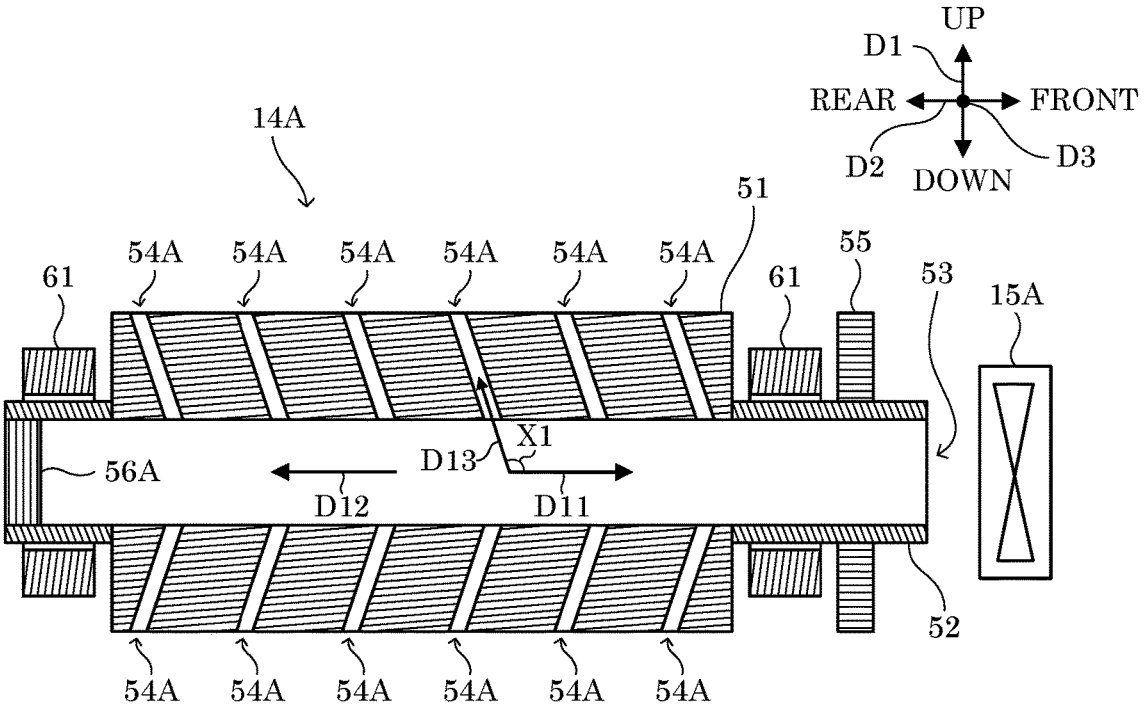
FIG. 3 is a diagram showing a configuration of an air suction conveying roller of the image forming apparatus according to the first embodiment of the present disclosure.
Figure 4:
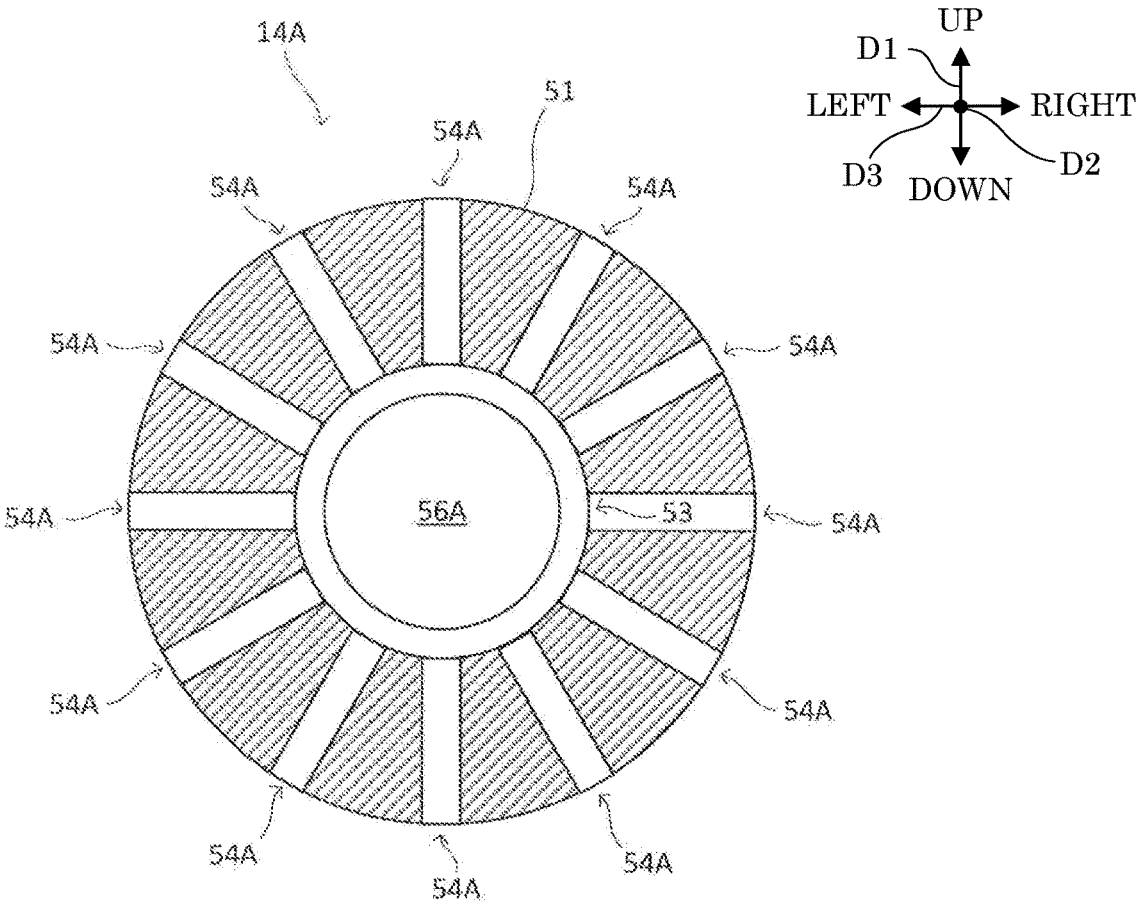
FIG. 4 is a diagram showing a configuration of the air suction conveying roller of the image forming apparatus according to the first embodiment of the present disclosure.

Next, a configuration of the web conveying portion 1A will be described with reference to FIG. 1, FIG. 3, and FIG. 4. FIG. 3 is a cross-sectional view showing a cross section of an air suction conveying roller 14A taken along a plane orthogonal to the left-right direction D3. FIG. 4 is a cross-sectional view showing a cross section of the air suction conveying roller 14A taken along a plane orthogonal to the front-rear direction D2.

The web conveying portion 1A includes the air suction conveying roller 14A shown in FIG. 3 and a fan 15A.

As shown in FIG. 1, the air suction conveying roller 14A is a conveying roller 13 arranged upstream of the image forming portion 2 in the conveying direction D4 of the web WE among the plurality of conveying rollers 13. It is noted that the air suction conveying roller 14A may be any conveying roller 13 arranged downstream of the image forming portion 2 in the conveying direction D4 of the web WE among the plurality of conveying rollers 13.

As shown in FIG. 3, the air suction conveying roller 14A includes a roller portion 51, a shaft portion 52, a first air passage 53, a second air passage 54A, a gear 55, and a closing portion 56A.

The roller portion 51 rotates in contact with the web WE to apply a conveying force along the conveying direction D4 to the web WE. The roller portion 51 is formed in a cylindrical shape elongated in the front-rear direction D2 (see FIG. 3 and FIG. 4).

The shaft portion 52 functions as a rotation shaft of the roller portion 51. The shaft portion 52 is provided at both ends of the roller portion 51 in the longitudinal direction (front-rear direction D2) of the roller portion 51. Each shaft portion 52 is formed in a cylindrical shape concentric with the roller portion 51. Each shaft portions 52 has an inner diameter that is the same size as the inner diameter of the roller portion 51. Each shaft portions 52 has an outer diameter smaller than the outer diameter of the roller portion 51. Each shaft portions 52 is provided so as to be rotatable together with the roller portion 51. The pair of shaft portions 52 is rotatably supported by a pair of bearing portions 61 (see FIG. 3) provided inside the image forming apparatus 100A. Thus, the roller portion 51 is supported rotatably around the shaft portion 52.

The first air passage 53 extends in the axial direction (front-rear direction D2) of the shaft portion 52 inside the outer peripheral portion of the roller portion 51, and communicates with the outside at an end on the side of the first direction D11 (see FIG. 3) parallel to the axial direction. As shown in FIG. 3, the first air passage 53 is composed of an inner peripheral portion of the roller portion 51 and inner peripheral portions of the shaft portions 52.

The second air passage 54A extends from the first air passage 53 in a first outward extension direction D13 (see FIG. 3) that forms an obtuse angle of a first angle X1 (see FIG. 3) with respect to the first direction D11, and communicates with the outside of the outer peripheral portion of the roller portion 51.

For example, the second air passage 54A is formed to have a circular cross-sectional shape orthogonal to the first outward extension direction D13. It is noted that the second air passage 54A may be formed to have a cross-sectional shape orthogonal to the first outward extension direction D13 that is different from a circular shape such as a polygon.

For example, the first angle X1 is 100 degrees. It is noted that the first angle X1 may be any angle larger than 90 degrees and smaller than 180 degrees.

As shown in FIG. 3, the air suction conveying roller 14A includes a plurality of second air passages 54A arranged along the axial direction (front-rear direction D2). For example, the air suction conveying roller 14A includes a plurality of second air passages 54A arranged at regular intervals along the axial direction.

As shown in FIG. 4, the air suction conveying roller 14A includes a plurality of second air passages 54A arranged along the outer peripheral portion of the roller portion 51. For example, the air suction conveying roller 14A includes a plurality of second air passages 54A arranged at regular intervals along the outer peripheral portion of the roller portion 51. For example, in the air suction conveying roller 14A, rows of the second air passages 54A arranged along the axial direction are arranged along the outer peripheral portion of the roller portion 51.

The gear 55 is provided on the outer peripheral portion of one of the two shaft portions 52. The gear 55 is provided so as to be rotatable together with the shaft portion 52. The gear 55 is supplied with rotational drive power transmitted from a drive portion (not shown). Thus, the gear 55, the shaft portions 52, and the roller portion 51 rotate together.

The closing portion 56A closes an end on a second direction D12 side of the first air passage 53 (see FIG. 3). The second direction D12 is the opposite direction of the first direction D11. The first air passage 53 is blocked from the outside by the closing portion 56A at the end on the second direction D12 side.

The fan 15A is provided corresponding to the air suction conveying roller 14A. The fan 15A generates an air current that flows in the first air passage 53 in the first direction D11. For example, as shown in FIG. 3, the fan 15A is an axial flow fan provided to face an end of the first air passage 53 in the first direction D11. The fan 15A is an example of the air current generation portion of the present disclosure.

When the fan 15A is driven, an air current that flows in the first air passage 53 in the first direction D11 is generated. Thus, an air current that flows in the second air passage 54A toward the first air passage 53 is generated. Therefore, the air outside the outer peripheral portion of the roller portion 51 is drawn into the second air passage 54A.

In the web conveying portion 1A, the second air passage 54A extends from the first air passage 53 in the first outward extension direction D13, which is at an obtuse angle with respect to the first direction D11. Thus, in comparison with the configuration in which the second air passage 54A extends from the first air passage 53 in a direction perpendicular to the first direction D11, the ventilation resistance at the connection portion between the second air passage 54A and the first air passage 53 is reduced. This makes it possible to efficiently suck air that enters between the web WE and the conveying roller 13.

In addition, as shown in FIG. 3, the air suction conveying roller 14A includes a plurality of second air passages 54A arranged along the axial direction (front-rear direction D2). Thus, it is possible to suck air that enters between the web WE and the conveying roller 13 in the entire area in the axial direction of the outer peripheral portion of the roller portion 51.

In addition, as shown in FIG. 4, the air suction conveying roller 14A includes a plurality of second air passages 54A arranged along the outer peripheral portion of the roller portion 51. This makes it possible to suck air that enters between the web WE and the conveying roller 13 in the entire area in the circumferential direction of the outer peripheral portion of the roller portion 51.

In addition, as shown in FIG. 3, the end of the first air passage 53 on the side of the second direction D12 opposite to the first direction D11 is blocked from the outside by the closing portion 56A. Thus, in comparison with the configuration in which the end of the first air passage 53 on the second direction D12 side communicates with the outside, it is possible to increase the negative pressure generated in each of the second air passages 54A by the driving of the fan 15A. This makes it possible to efficiently suck air that enters between the web WE and the conveying roller 13.

In addition, as shown in FIG. 1, the air suction conveying roller 14A is disposed upstream of the image forming portion 2 in the conveying direction D4. This can inhibit the conveying roller 13 from slipping against the web WE upstream of the image forming portion 2 in the conveying direction D4. Therefore, it is possible to suppress the occurrence of a delay in the conveyance of the web WE to the image forming portion 2. Accordingly, it is possible to suppress the deterioration of the image quality of the image formed by the image forming portion 2 due to the delay in the conveyance of the web WE to the image forming portion 2.

As described above, in the image forming apparatus 100A, the second air passage 54A extends from the first air passage 53 in the first outward extension direction D13, which is at an obtuse angle with respect to the first direction D11. Thus, in comparison with the configuration in which the second air passage 54A extends outward from the first air passage 53 in a direction perpendicular to the first direction D11, it is possible to efficiently suck air that enters between the web WE and the conveying roller 13.

[Modifications]

When the plurality of second air passages 54A are arranged along the first direction D11, the negative pressure generated when the fan 15A is driven is uneven among the plurality of second air passages 54A. Specifically, the more upstream in the first direction D11 (the further away from the fan 15A) the position of the second air passage 54A is, the weaker the negative pressure generated in that second air passage 54A is. This may result in insufficient air suction upstream in the first direction D11 on the outer peripheral portion of the roller portion 51, causing the air suction conveying roller 14A to slip against the web WE.

As a countermeasure, it is conceivable to adjust the arrangement intervals between the plurality of second air passages 54A arranged along the axial direction (front-rear direction D2).

Figure 5:
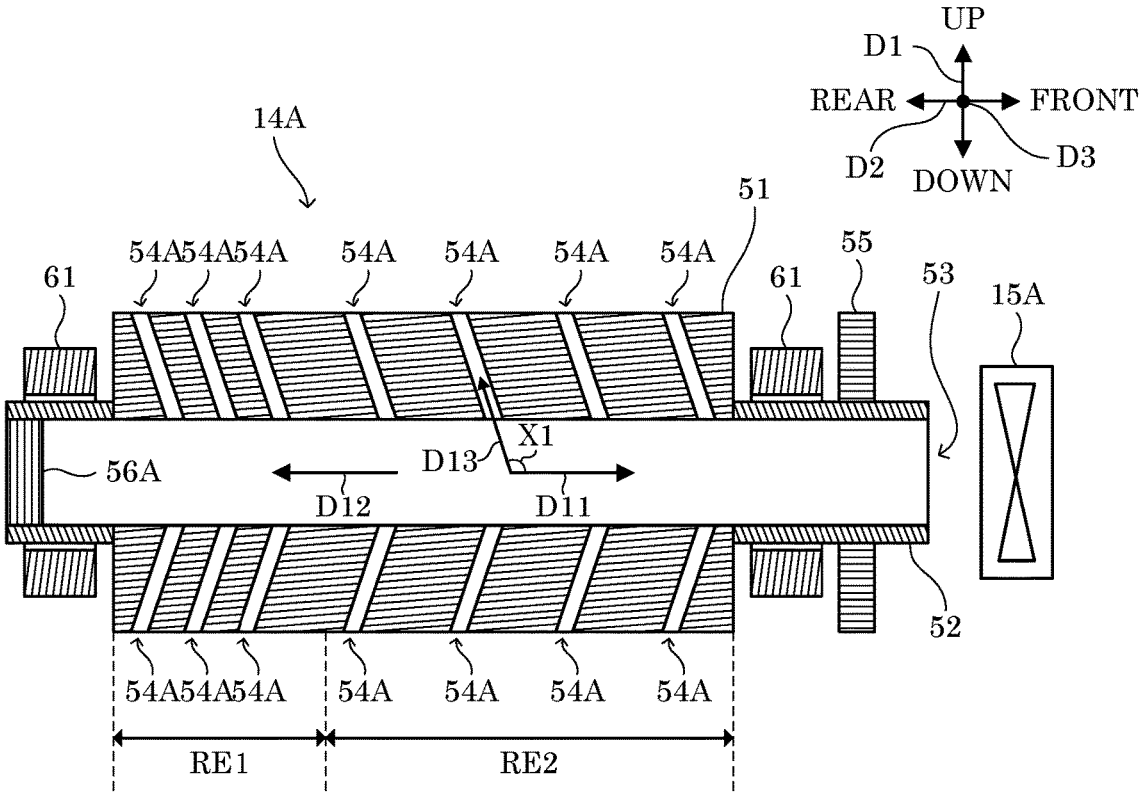
FIG. 5 is a diagram showing a modification of the air suction conveying roller of the image forming apparatus according to the first embodiment of the present disclosure.

For example, as shown in FIG. 5, among the plurality of second air passages 54A arranged along the axial direction (front-rear direction D2), the second air passages 54A provided in a first region RE1 (see FIG. 5) including the end of the roller portion 51 on the upstream side in the first direction D11 may each have a narrower interval from another adjacent second air passage 54A than the second air passages 54A provided in a second region RE2 (see FIG. 5) including the end of the roller portion 51 on the downstream side in the first direction D11 and located on the first direction D11 side of the first region RE1. Thus, in comparison with the configuration in which the plurality of second air passages 54A are arranged at regular intervals along the axial direction, it is possible to increase the negative pressure generated in the second air passages 54A disposed upstream in the first direction D11 in the roller portion 51 when the fan 15A is driven.

Here, the second region RE2 may be a region adjacent to the first region RE1 or a region separated from the first region RE1 in the axial direction. When there is another region between the first region RE1 and the second region RE2, the second air passages 54A provided in the other region may have an interval from another adjacent second air passage 54A that is wider than those of the second air passages 54A provided in the first region RE1 and narrower than those of the second air passages 54A provided in the second region RE2.

In addition, each of the plurality of second air passages 54A arranged along the axial direction (front-rear direction D2) may be formed so that the closer the arrangement position is to the end of the roller portion 51 on the upstream side in the first direction D11, the narrower the interval between the second air passage 54A and another adjacent second air passage 54A is. Thus, it is possible to reduce the difference in negative pressure generated when the fan 15A is driven between the plurality of second air passages 54A.

In addition, it is also conceivable to adjust the cross-sectional area of each of the plurality of second air passages 54A arranged along the axial direction (front-rear direction D2) taken along a plane orthogonal to the first outward extension direction D13.

Figure 6:
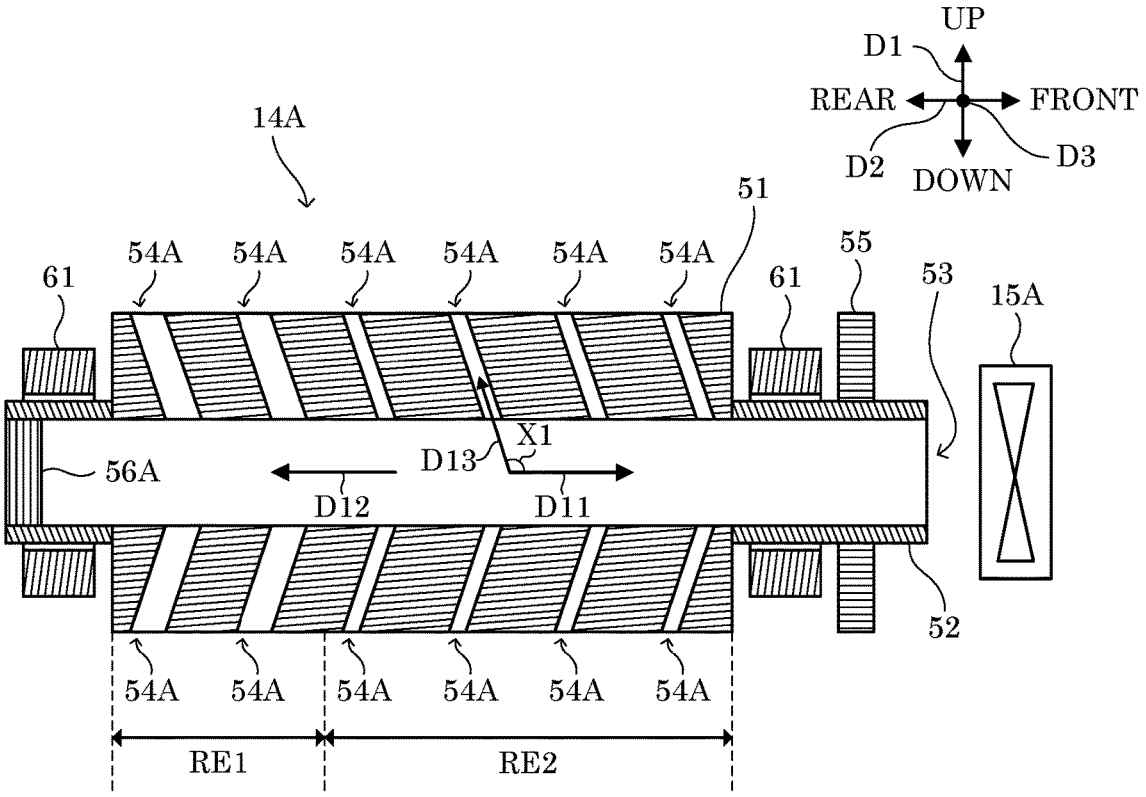
FIG. 6 is a diagram showing a modification of the air suction conveying roller of the image forming apparatus according to the first embodiment of the present disclosure.

For example, as shown in FIG. 6, among the plurality of second air passages 54A arranged along the axial direction (front-rear direction D2), the second air passages 54A provided in the first region RE1 (see FIG. 6) may have a larger cross-sectional area along the plane orthogonal to the first outward extension direction D13 than the second air passages 54A provided in the second region RE2 (see FIG. 6). Thus, in comparison with the configuration in which the cross-sectional areas of the plurality of second air passages 54A are the same, it is possible to increase the negative pressure generated in the second air passages 54A disposed upstream in the first direction D11 in the roller portion 51 when the fan 15A is driven.

Here, when there is another region between the first region RE1 and the second region RE2, the second air passages 54A provided in the other region may each have a cross-sectional area that is smaller than those of the second air passages 54A provided in the first region RE1 and larger than those of the second air passages 54A provided in the second region RE2.

In addition, each of the plurality of second air passages 54A arranged along the axial direction (front-rear direction D2) may be formed so that the closer the arrangement position is to the end of the roller portion 51 on the upstream side in the first direction D11, the larger the cross-sectional area along the plane orthogonal to the first outward extension direction D13 is. Thus, it is possible to reduce the difference in negative pressure generated when the fan 15A is driven between the plurality of second air passages 54A.

In addition, it is conceivable to adjust the angle of the first outward extension direction D13 with respect to the first direction D11 of each of the plurality of second air passages 54A arranged along the axial direction (front-rear direction D2).

Figure 7:
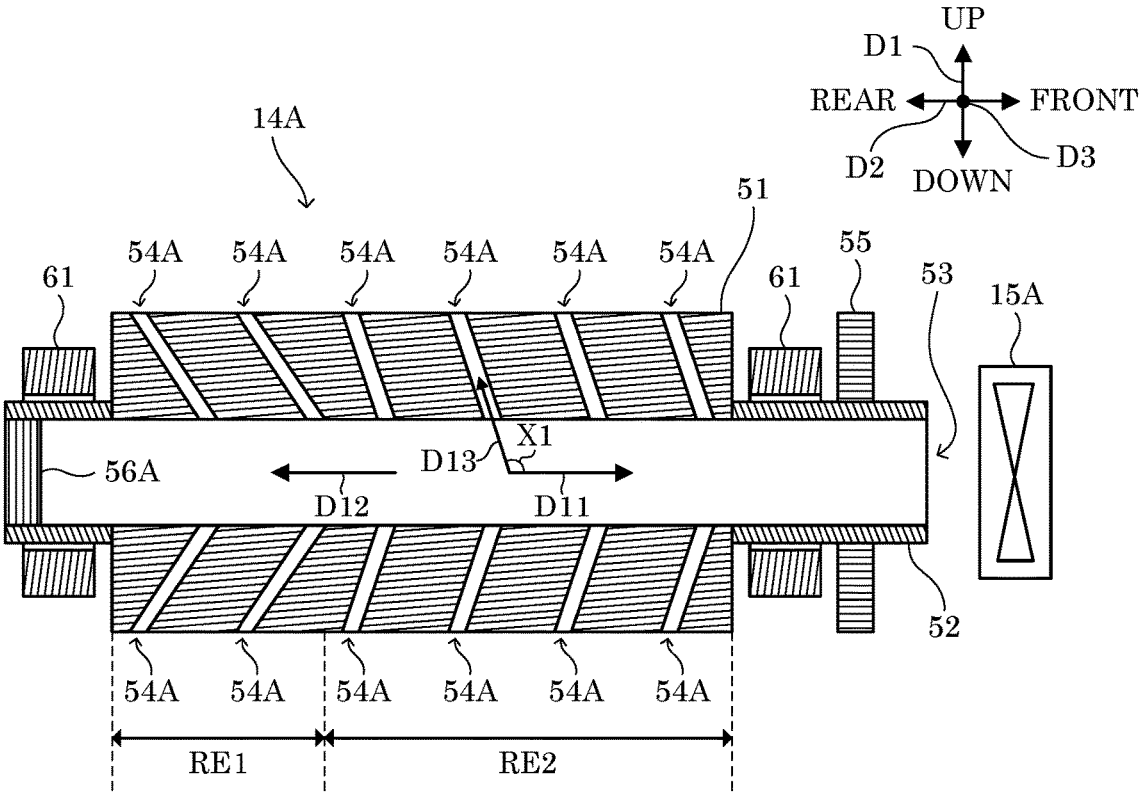
FIG. 7 is a diagram showing a modification of the air suction conveying roller of the image forming apparatus according to the first embodiment of the present disclosure.

For example, as shown in FIG. 7, among the plurality of second air passages 54A arranged along the axial direction (front-rear direction D2), the second air passages 54A provided in the first region RE1 (see FIG. 7) may have a larger obtuse angle of the first outward extension direction D13 with respect to the first direction D11 than the second air passages 54A provided in the second region RE2 (see FIG. 7). Thus, in comparison with the configuration in which the plurality of second air passages 54A have the same angle of the first outward extension direction D13 with respect to the first direction D11, it is possible to increase the negative pressure generated in the second air passages 54A disposed upstream in the first direction D11 in the roller portion 51 when the fan 15A is driven.

Here, when there is another region between the first region RE1 and the second region RE2, the second air passages 54A provided in the other region may have an angle of the first outward extension direction D13 with respect to the first direction D11 that is smaller than that of the second air passages 54A provided in the first region RE1 and larger than that of the second air passages 54A provided in the second region RE2.

In addition, each of the plurality of second air passages 54A arranged along the axial direction (front-rear direction D2) may be formed so that the closer the arrangement position is to the end of the roller portion 51 on the upstream side in the first direction D11, the larger the obtuse angle that the first outward extension direction D13 forms with respect to the first direction D11 is. Thus, it is possible to reduce the difference in negative pressure generated when the fan 15A is driven between the plurality of second air passages 54A.

When the suction mechanism is provided separately from the conveying roller 13 as in the web conveying device according to the related art described above, the scale of the apparatus becomes large.

In contrast, an image forming apparatus 100B according to a second embodiment of the present disclosure can reduce the size of the apparatus as will be described below.

Second Embodiment

Figure 8:
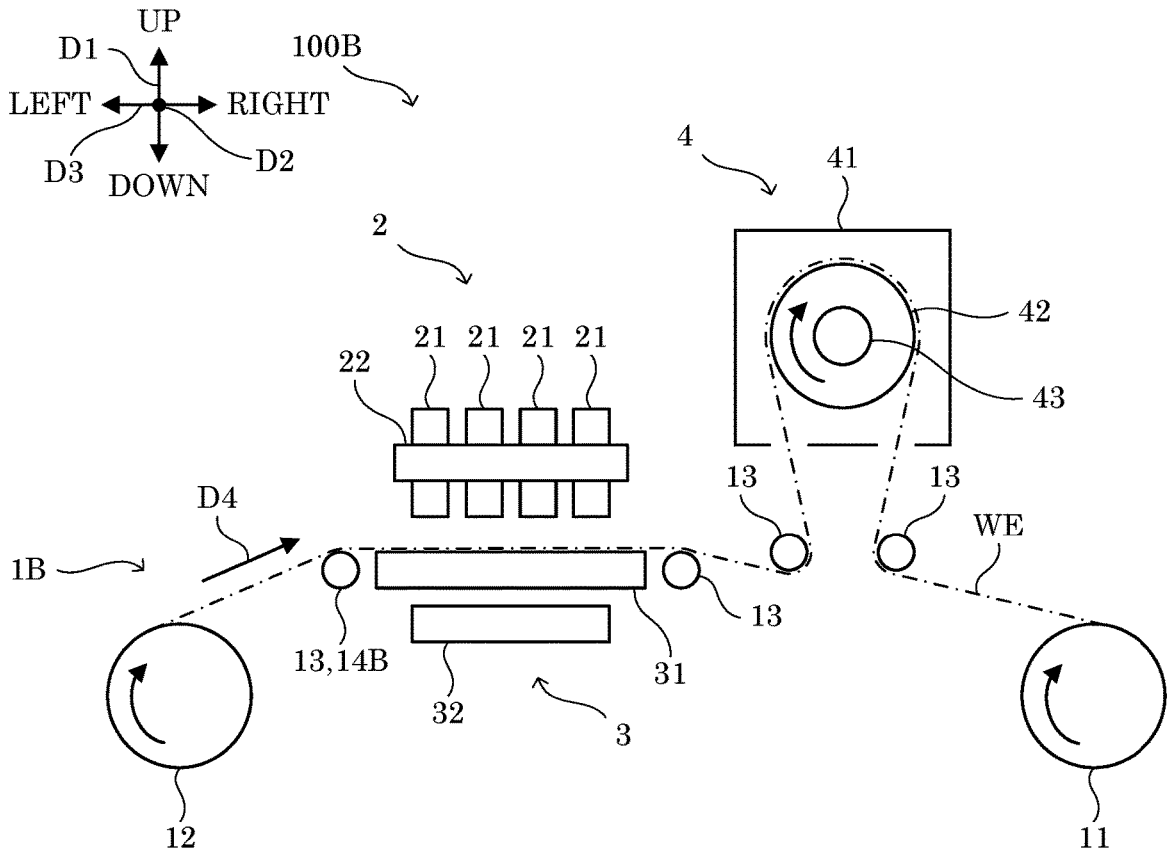
FIG. 8 is a diagram showing a configuration of an image forming apparatus according to a second embodiment of the present disclosure.
Figure 9:
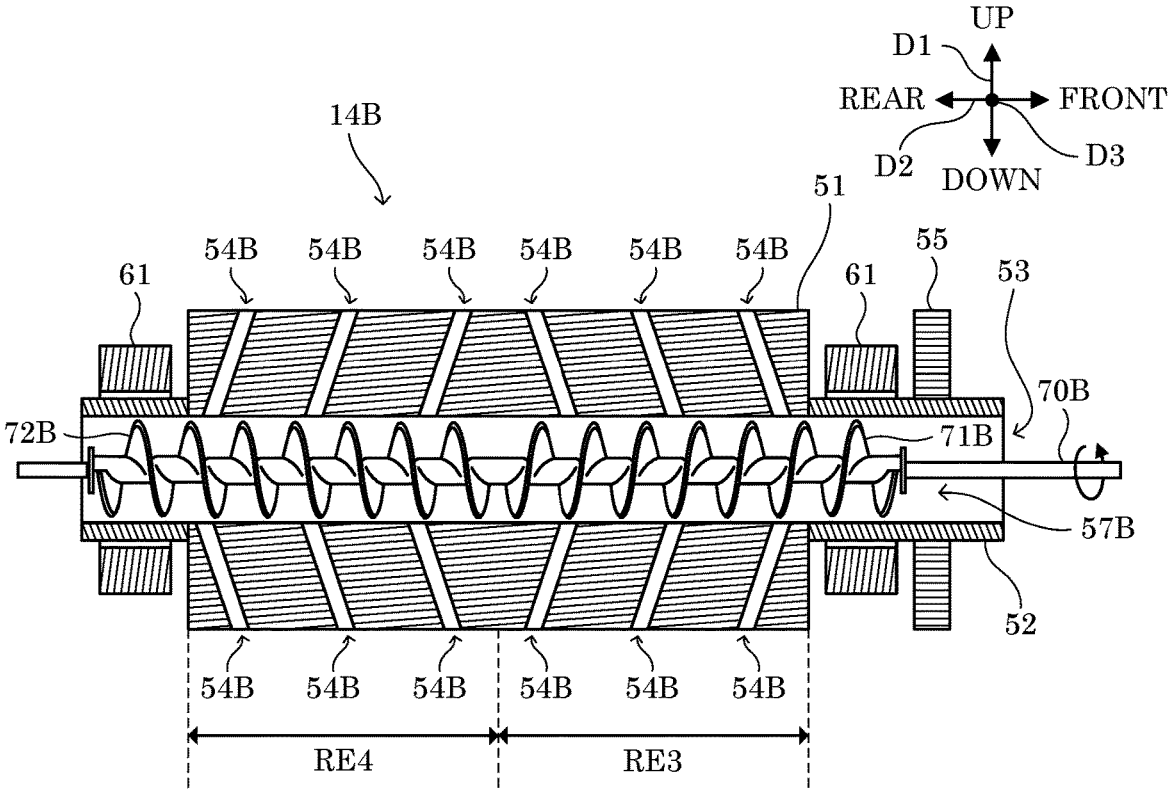
FIG. 9 is a diagram showing a configuration of an air suction conveying roller of the image forming apparatus according to the second embodiment of the present disclosure.
Figure 10:
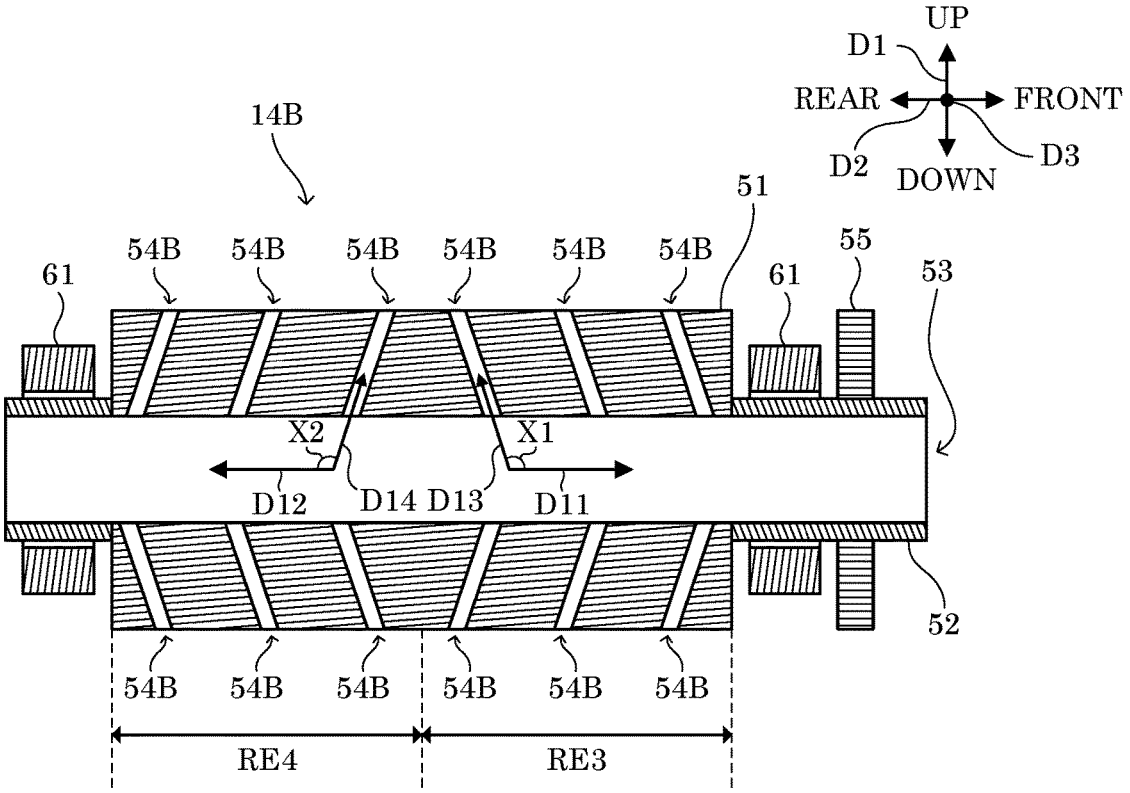
FIG. 10 is a diagram showing a configuration of the air suction conveying roller of the image forming apparatus according to the second embodiment of the present disclosure.
Figure 11:
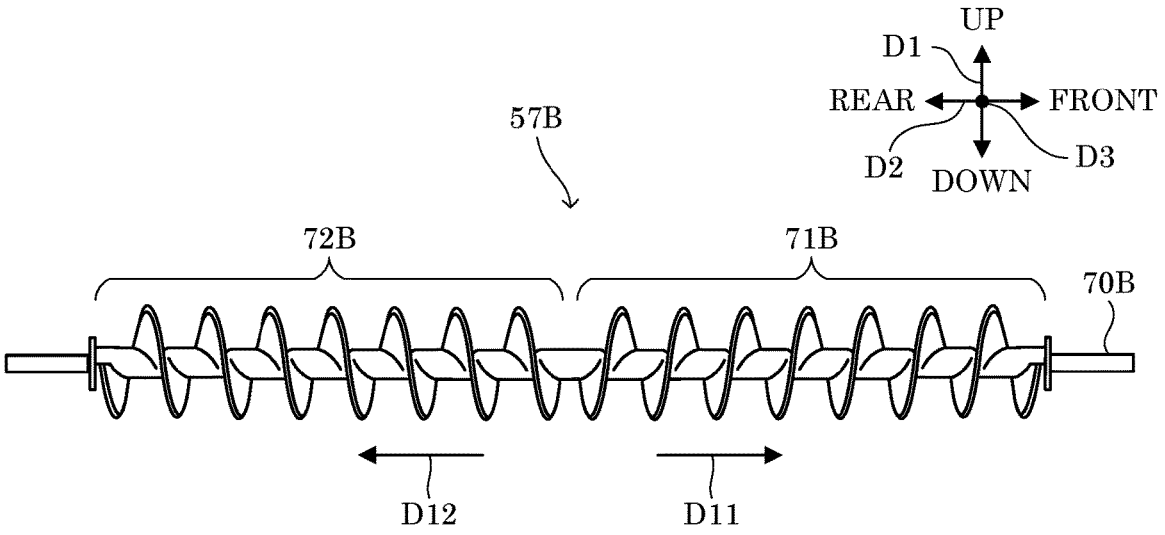
FIG. 11 is a diagram showing a configuration of a screw conveyor of the image forming apparatus according to the second embodiment of the present disclosure.

A configuration of the image forming apparatus 100B according to the second embodiment of the present disclosure will be described below with reference to FIG. 1, FIG. 3, and FIG. 8 to FIG. 11. Here, FIG. 8 is a cross-sectional view showing a configuration of the image forming apparatus 100B. In addition, FIG. 9 is a cross-sectional view of an air suction conveying roller 14B taken along a plane orthogonal to the left-right direction D3. In addition, FIG. 10 is a view showing a state in which a screw conveyor 57B is removed from the air suction conveying roller 14B shown in FIG. 9. In addition, FIG. 11 is a left side view showing a configuration of the screw conveyor 57B.

As shown in FIG. 1 and FIG. 8, the image forming apparatus 100B is different from the image forming apparatus 100A in that the image forming apparatus 100B includes a web conveying portion 1B instead of the web conveying portion 1A. It is noted that the other points are common to the image forming apparatus 100A and the image forming apparatus 100B.

As shown in FIG. 1, FIG. 3, FIG. 8, and FIG. 9, the web conveying portion 1B is different from the web conveying portion 1A in that the web conveying portion 1B includes an air suction conveying roller 14B instead of the air suction conveying roller 14A, and does not include the fan 15A. It is noted that the other points are common to the web conveying portion 1A and the web conveying portion 1B. The web conveying portion 1B is another example of the web conveying device of the present disclosure.

As shown in FIG. 8, the air suction conveying roller 14B is a conveying roller 13 arranged upstream of the image forming portion 2 in the conveying direction D4 of the web WE among the plurality of conveying rollers 13. It is noted that the air suction conveying roller 14B may be any conveying roller 13 arranged downstream of the image forming portion 2 in the conveying direction D4 of the web WE among the plurality of conveying rollers 13.

As shown in FIG. 3 and FIG. 9, the air suction conveying roller 14B is different from the air suction conveying roller 14A in that the air suction conveying roller 14B includes a second air passage 54B instead of the second air passage 54A, does not include the closing portion 56A, and includes a screw conveyor 57B. It is noted that the other points are common to the air suction conveying roller 14A and the air suction conveying roller 14B.

The second air passage 54B extends from the first air passage 53 in a direction intersecting the first direction D11 (see FIG. 10) and communicates with the outside of the outer peripheral portion of the roller portion 51.

As shown in FIG. 9 and FIG. 10, the air suction conveying roller 14B includes a plurality of second air passages 54B arranged along the axial direction (front-rear direction D2).

Similarly to the air suction conveying roller 14A, the air suction conveying roller 14B includes a plurality of second air passages 54B arranged along the outer peripheral portion of the roller portion 51. For example, the air suction conveying roller 14B includes a plurality of second air passages 54B arranged at regular intervals along the outer peripheral portion of the roller portion 51.

The air suction conveying roller 14B does not include the closing portion 56A (see FIG. 3). Therefore, an end of the first air passage 53 of the air suction conveying roller 14B on the side of the second direction D12 (see FIG. 10) opposite to the first direction D11 (see FIG. 10) communicates with the outside.

The screw conveyor 57B is provided in the first air passage 53, and generates an air current that flows in the second air passage 54B toward the first air passage 53. The screw conveyor 57B is another example of the air current generation portion of the present disclosure.

As shown in FIG. 9 and FIG. 11, the screw conveyor 57B includes a shaft portion 70B, a first screw portion 71B, and a second screw portion 72B.

The shaft portion 70B is formed in a cylindrical shape elongated in the front-rear direction D2. The shaft portion 70B is rotatably supported by a bearing portion (not shown).

The first screw portion 71B generates an air current that flows in the first direction D11 in a third region RE3 (see FIG. 9 and FIG. 10) on the first direction D11 (see FIG. 10) side of the center portion of the roller portion 51 in the axial direction (front-rear direction D2).

As shown in FIG. 9 and FIG. 11, the first screw portion 71B is formed on the front side of the shaft portion 70B in the front-rear direction D2. In addition, the first screw portion 71B is provided in the third region RE3 of the roller portion 51. The first screw portion 71B is a blade formed in a spiral shape. It is noted that the first screw portion 71B may be a plurality of blades arranged at regular intervals along the extending direction of the shaft portion 70B.

The second screw portion 72B generates an air current that flows in the second direction D12 in a fourth region RE4 (see FIG. 9 and FIG. 10) on the second direction D12 (see FIG. 10) side of the center portion of the roller portion 51 in the axial direction (front-rear direction D2).

As shown in FIG. 9 and FIG. 11, the second screw portion 72B is formed on the rear side of the shaft portion 70B in the front-rear direction D2. In addition, the second screw portion 72B is provided in the fourth region RE4 of the roller portion 51. The second screw portion 72B is a blade formed in a spiral shape. It is noted that the second screw portion 72B may be a plurality of blades arranged at regular intervals along the extending direction of the shaft portion 70B.

As shown in FIG. 9, the first screw portion 71B and the second screw portion 72B are provided so as to be symmetrical with respect to a plane orthogonal to the front-rear direction D2 and including the central portion of the roller portion 51 in the axial direction (front-rear direction D2).

The screw conveyor 57B receives rotational drive power supplied by a drive portion (not shown) and rotates in the direction of the arrow shown in FIG. 9. Thus, in the third region RE3 (see FIG. 9), an air current that flows in the first direction D11 (see FIG. 10) is generated. Therefore, in each of the second air passages 54B provided in the third region RE3, an air current that flows toward the first air passage 53 is generated. In addition, in the fourth region RE4 (see FIG. 9), an air current that flows in the second direction D12 (see FIG. 10) is generated. Therefore, in each of the second air passages 54B provided in the fourth region RE4, an air current that flows toward the first air passage 53 is generated.

Here, as shown in FIG. 9 and FIG. 10, among the plurality of second air passages 54B arranged along the axial direction (front-rear direction D2), each of the second air passages 54B provided in the third region RE3 extends from the first air passage 53 in the first outward extension direction D13 (see FIG. 10), which forms an obtuse angle of the first angle X1 (see FIG. 10) with respect to the first direction D11.

Thus, in comparison with a configuration in which each of the second air passages 54B provided in the third region RE3 extends from the first air passage 53 in the radial direction of the roller portion 51, it is possible to reduce the ventilation resistance of each of the connection portions between the first air passage 53 and the second air passages 54B in the third region RE3.

In addition, as shown in FIG. 9 and FIG. 10, among the plurality of second air passages 54B arranged along the axial direction (front-rear direction D2), each of the second air passages 54B provided in the fourth region RE4 extends from the first air passage 53 in the second outward extension direction D14 (see FIG. 10), which forms an obtuse angle of the second angle X2 (see FIG. 10) with respect to the second direction D12.

Thus, in comparison with a configuration in which each of the second air passages 54B provided in the fourth region RE4 extends from the first air passage 53 in the radial direction of the roller portion 51, it is possible to reduce the ventilation resistance of each of the connection portions between the first air passage 53 and the second air passages 54B in the fourth region RE4.

For example, the plurality of second air passages 54B provided in the third region RE3 and the plurality of second air passages 54B provided in the fourth region RE4 are formed so as to be symmetrical with respect to a plane orthogonal to the front-rear direction D2 and including the central portion of the roller portion 51 in the axial direction (front-rear direction D2) (see FIG. 10). In this case, the second angle X2 is the same angle as the first angle X1.

For example, each of the second air passages 54B provided in the third region RE3 is formed to have a circular cross-sectional shape orthogonal to the first outward extension direction D13. In addition, the plurality of second air passages 54B provided in the third region RE3 are arranged at regular intervals along the axial direction. In addition, each of the second air passages 54B provided in the fourth region RE4 is formed to have a circular cross-sectional shape orthogonal to the second outward extension direction D14. In addition, the plurality of second air passages 54B provided in the fourth region RE4 are arranged at regular intervals along the axial direction.

As described above, in the image forming apparatus 100B, the first air passage 53 is provided with an air current generation portion (screw conveyor 57B) that generates an air current that flows in the second air passage 54B toward the first air passage 53. This makes it possible to reduce the size of the apparatus in comparison with a configuration in which the air current generation portion is provided separately from the conveying roller 13.

It is noted that each of the plurality of second air passages 54B arranged along the axial direction may extend from the first air passage 53 in the radial direction of the roller portion 51.

Further, the screw conveyor 57B may not include the second screw portion 72B. In this case, the first screw portion 71B may be provided so as to correspond to the entire area in the axial direction of the roller portion 51. In addition, the first air passage 53 may have an end on the second direction D12 side blocked from the outside. In addition, each of the plurality of second air passages 54B arranged along the axial direction may extend from the first air passage 53 in the first outward extension direction D13, which forms an obtuse angle of the first angle X1 with respect to the first direction D11.

[Appendixes to Disclosure]

The following are appendixes to the overview of the disclosure extracted from the above embodiments. It is noted that the structures and processing functions to be described in the following appendixes can be selected and combined arbitrarily.

<Appendix 1>

A web conveying device comprising: a roller portion configured to rotate in contact with a web; a first air passage extending in an axial direction of a rotation shaft of the roller portion inside an outer peripheral portion of the roller portion and communicating with an outside at an end on a side of a first direction parallel to the axial direction; a second air passage extending from the first air passage in a direction that forms an obtuse angle with respect to the first direction and communicating with the outside of the outer peripheral portion; and an air current generation portion configured to generate an air current that flows in the first air passage in the first direction.

<Appendix 2>

The web conveying device according to Appendix 1, comprising a plurality of the second air passages arranged along the axial direction.

<Appendix 3>

The web conveying device according to Appendix 2, wherein, among the plurality of second air passages arranged along the axial direction, a second air passage provided in a first region including an end of the roller portion on an upstream side in the first direction has a narrower interval from another adjacent second air passage than a second air passage provided in a second region including an end of the roller portion on a downstream side in the first direction and located on the side of the first direction of the first region.

<Appendix 4>

The web conveying device according to Appendix 2, wherein each of the plurality of second air passages arranged along the axial direction is formed such that the closer an arrangement position is to an end of the roller portion on an upstream side in the first direction, the narrower an interval from another adjacent second air passage is.

<Appendix 5>

The web conveying device according to Appendix 2, wherein among the plurality of second air passages arranged along the axial direction, a second air passage provided in a first region including an end of the roller portion on an upstream side in the first direction has a larger cross-sectional area than a second air passage provided in a second region including an end of the roller portion on a downstream side in the first direction and located on the side of the first direction of the first region.

<Appendix 6>

The web conveying device according to Appendix 2, wherein each of the plurality of second air passages arranged along the axial direction is formed so that the closer an arrangement position is to an end of the roller portion on an upstream side in the first direction, the larger a cross-sectional area is.

<Appendix 7>

The web conveying device according to Appendix 2, wherein, among the plurality of second air passages arranged along the axial direction, a second air passage provided in a first region including an end of the roller portion on an upstream side in the first direction has a larger obtuse angle of an outward extension direction from the first air passage with respect to the first direction than a second air passage provided in a second region including an end of the roller portion on a downstream side in the first direction and located on the side of the first direction of the first region.

<Appendix 8>

The web conveying device according to Appendix 2, wherein each of the plurality of second air passages arranged along the axial direction is formed such that the closer an arrangement position is to an end of the roller portion on an upstream side in the first direction, the larger an obtuse angle of an outward extension direction from the first air passage with respect to the first direction is.

<Appendix 9>

The web conveying device according to any one of Appendices 1 to 8, comprising a plurality of the second air passages arranged along the outer peripheral portion.

<Appendix 10>

The web conveying device according to any one of Appendices 1 to 9, wherein an end of the first air passage on a side of a direction opposite to the first direction is blocked from the outside.

<Appendix 11>

An image forming apparatus comprising: the web conveying device according to any one of Appendices 1 to 10; and an image forming portion configured to form an image on the web conveyed by the web conveying device.

<Appendix 12>

The image forming apparatus according to Appendix 11, wherein the roller portion comes into contact with the web upstream of the image forming portion in a conveying direction of the web.

<Appendix 13>

A conveying roller comprising: a roller portion configured to rotate in contact with a web; a first air passage extending in an axial direction of a rotation shaft of the roller portion inside an outer peripheral portion of the roller portion and communicating with an outside at an end on a side of a first direction parallel to the axial direction; a second air passage extending from the first air passage in a direction that forms an obtuse angle with respect to the first direction and communicating with the outside of the outer peripheral portion.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A conveying roller comprising:

a roller portion configured to rotate in contact with a web;

a first air passage extending, in an axial direction of a rotation shaft of the roller portion, inside an outer peripheral portion of the roller portion and communicating with an outside at an end on a side of a first direction parallel to the axial direction; and a plurality of second air passages extending from the first air passage in a direction that forms an obtuse angle with respect to the first direction and communicating with the outside of the outer peripheral portion, wherein the second air passages are arranged in the axial direction, the second air passages are arranged along the outer peripheral portion, the first air passage includes a closed end and an open end, wherein the closed end is located at an upstream side of the first direction and is blocked from the outside, and the open end is located at a downstream side of the first direction, and is open to the outside, and each of the plurality of second air passages arranged in the axial direction is formed such that the closer an arrangement position is to the closed end of the first air passage on the upstream side of the first direction, the narrower an interval between adjacent second air passages.

2. A web conveying device comprising:

the conveying roller according to claim 1; and an air current generation portion configured to generate an air current that flows within the first air passage of the conveying roller in the first direction.

3. An image forming apparatus comprising:

the web conveying device according to claim 2; and an image forming portion configured to form an image on the web conveyed by the web conveying device.

4. The image forming apparatus according to claim 3, wherein the roller portion of the conveying roller is configured to come into contact with the web upstream of the image forming portion in a conveying direction of the web.

5. A conveying roller comprising:

a roller portion configured to rotate in contact with a web;

a first air passage extending, in an axial direction of a rotation shaft of the roller portion, inside an outer peripheral portion of the roller portion and communicating with an outside at an end on a side of a first direction parallel to the axial direction; and a plurality of second air passages extending from the first air passage in a direction that forms an obtuse angle with respect to the first direction and communicating with the outside of the outer peripheral portion, wherein the second air passages are arranged along the axial direction, the second air passages are arranged along the outer peripheral portion, the first air passage includes a closed end and an open end, wherein the closed end is located at an upstream side of the first direction and is blocked from the outside, and the open end is located at a downstream side of the first direction, and is open to the outside, and each of the plurality of second air passages arranged along the axial direction is formed such that the closer an arrangement position is to the closed end of the first air passage on the upstream side in the first direction, the larger a cross-sectional area of each of the plurality of second air passages.

6. A web conveying device comprising:

the conveying roller according to claim 5; and an air current generation portion configured to generate an air current that flows within the first air passage of the conveying roller in the first direction.

7. An image forming apparatus comprising:

the web conveying device according to claim 6; and an image forming portion configured to form an image on the web conveyed by the web conveying device.

8. The image forming apparatus according to claim 7, wherein the roller portion of the conveying roller is configured to come into contact with the web upstream of the image forming portion in a conveying direction of the web.

9. A conveying roller comprising:

a roller portion configured to rotate in contact with a web;

a first air passage extending, in an axial direction of a rotation shaft of the roller portion, inside an outer peripheral portion of the roller portion and communicating with an outside at an end on a side of a first direction parallel to the axial direction; and a plurality of second air passages extending from the first air passage in an outward extension direction that forms an obtuse angle with respect to the first direction and communicating with the outside of the outer peripheral portion, wherein the second air passages are arranged along the axial direction, the second air passages are arranged along the outer peripheral portion, the first air passage includes a closed end and an open end, wherein the closed end is located at an upstream side of the first direction and is blocked from the outside, and the open end is located at a downstream side of the first direction, and is open to the outside, and each of the plurality of second air passages arranged along the axial direction is formed such that the closer an arrangement position is to the closed end of the first air passage on the upstream side in the first direction, the larger the obtuse angle formed between the outward extension direction of each of the plurality of second air passages and the first direction of the first air passage.

10. A web conveying device comprising:

the conveying roller according to claim 9; and an air current generation portion configured to generate an air current that flows within the first air passage of the conveying roller in the first direction.

11. An image forming apparatus comprising:

the web conveying device according to claim 10; and an image forming portion configured to form an image on the web conveyed by the web conveying device.

12. The image forming apparatus according to claim 11, wherein the roller portion of the conveying roller is configured to come into contact with the web upstream of the image forming portion in a conveying direction of the web.

* * * * *